US009790598B2

(12) United States Patent
Guillemette et al.

(10) Patent No.: US 9,790,598 B2
(45) Date of Patent: Oct. 17, 2017

(54) REMOVABLE MASK FOR COATING A SUBSTRATE

(71) Applicant: Sikorsky Aircraft Corporation, Stratford, CT (US)

(72) Inventors: Robert Guillemette, Durham, CT (US); John Bartalotta, New Britain, CT (US); Linda Fabian, Northford, CT (US); Gregory C. Papachristos, Stratford, CT (US)

(73) Assignee: SIKORSKY AIRCRAFT CORPORATION, Stratford, CT (US)

( * ) Notice: Subject to any disclaimer, the term of this patent is extended or adjusted under 35 U.S.C. 154(b) by 657 days.

(21) Appl. No.: 13/973,308

(22) Filed: Aug. 22, 2013

(65) Prior Publication Data

US 2015/0056427 A1 Feb. 26, 2015

(51) Int. Cl.

| | |
|---|---|
| ***C23C 28/00*** | (2006.01) |
| ***C23C 8/44*** | (2006.01) |
| ***C23C 8/02*** | (2006.01) |
| ***C23C 8/20*** | (2006.01) |
| ***C25D 3/38*** | (2006.01) |
| ***C25D 5/48*** | (2006.01) |

(Continued)

(52) U.S. Cl.

CPC ..... *C23C 28/34* (2013.01); *C23C 8/02* (2013.01); *C23C 8/20* (2013.01); *C23C 8/44* (2013.01); *C23C 22/73* (2013.01); *C23C 28/322* (2013.01); *C23C 28/341* (2013.01); *C25D 3/38* (2013.01); *C25D 5/022* (2013.01); *C25D 5/34* (2013.01); *C25D 5/48* (2013.01); *C23C 22/34* (2013.01); *C23C 2222/10* (2013.01); *Y10T 428/24917* (2015.01)

(58) Field of Classification Search

CPC ..... C23C 22/30; C23C 22/34; C23C 22/52; C23C 22/63; C25D 5/02; C25D 5/022

See application file for complete search history.

(56) References Cited

U.S. PATENT DOCUMENTS 4,169,022 A * 9/1979 Ward ..... C25D 3/06 205/224
4,358,349 A * 11/1982 Masami ..... H05K 3/108 205/126

(Continued)

FOREIGN PATENT DOCUMENTS

GB 953576 3/1964
GB 1448585 * 8/1976

(Continued)

*Primary Examiner* — Louis Rufo
(74) *Attorney, Agent, or Firm* — Cantor Colburn LLP

(57) ABSTRACT

A system and a method for selectively coating a substrate includes a removable mask including a magnetic member having a first surface contour shaped to conform to the outside surface of the substrate and a magnetizable member having a second surface contour shaped to conform to the inside surface of the substrate. The method for coating the substrate includes magnetically coupling a removable mask to at least one surface of the substrate; forming a coating of a coating material on the at least one surface of the substrate with the magnetically coupled removable mask using a bath containing the coating material; and selectively decoupling the removable mask from the at least one coated surface to reveal a portion of the coated surface without the coating.

14 Claims, 3 Drawing Sheets

(51) Int. Cl.

| | |
|---|---|
| ***C23C 22/73*** | (2006.01) |
| ***C25D 5/02*** | (2006.01) |
| ***C23C 22/34*** | (2006.01) |
| ***C25D 5/34*** | (2006.01) |

(56) References Cited

U.S. PATENT DOCUMENTS

| | | | | |
|---|---|---|---|---|
| 4,997,529 | A * | 3/1991 | Totsuka | C25D 11/00 204/224 R |
| 5,885,667 | A | 3/1999 | Calfat | |
| 5,950,908 | A * | 9/1999 | Fujino | H01L 21/6835 228/248.1 |
| 6,004,448 | A * | 12/1999 | Martyak | C25D 9/08 205/178 |
| 2009/0301894 | A1* | 12/2009 | Ehlers | C23C 18/165 205/170 |
| 2010/0180793 | A1* | 7/2010 | Dingwerth | C23C 22/83 106/14.41 |
| 2011/0308955 | A1* | 12/2011 | Olson | H01L 21/68728 205/123 |
| 2012/0052205 | A1* | 3/2012 | Wang | H05K 5/0243 427/259 |
| 2013/0043135 | A1* | 2/2013 | Demers | C25D 5/022 205/50 |

FOREIGN PATENT DOCUMENTS

| | | |
|---|---|---|
| JP | 56090997 | 7/1981 |
| JP | 04193978 A * | 7/1992 |

* cited by examiner

REMOVABLE MASK FOR COATING A SUBSTRATE

BACKGROUND

The subject matter disclosed herein relates generally to the field of manufacturing and, more particularly, to a removable magnetic mask for masking areas of a substrate to be coated or processed.

DESCRIPTION OF RELATED ART

Typically, masking materials, such as vinyl adhesive tapes and lead tapes are used to prevent coatings from being deposited in areas that are covered with the masked material. For example, lead tape is used to mask flat areas of a metallic substrate in order to prevent deposition of copper plating. However, on flat areas, vinyl masking materials lift off during processing, thereby compromising the integrity of the coating process. Additionally, conductive and non-conductive coatings are applied through the coating process at different times and may need to be removed using chemicals. These chemicals pose an environmental risk during the coating process. An improved method of masking certain areas for applying coatings or other materials during processing would be well received in the field.

BRIEF SUMMARY

According to one aspect of the invention, a method for selectively coating a substrate, includes magnetically coupling a removable mask to at least one surface of the substrate; forming a coating of a coating material on the at least one surface of the substrate with the magnetically coupled removable mask using a bath containing the coating material; and selectively decoupling the removable mask from the at least one coated surface to reveal a portion of the surface without the coating.

According to another aspect of the invention, a system for coating a substrate having an inside surface and an outside surface includes a removable mask with a magnetic member having a first surface contour shaped to conform to the outside surface; and a magnetizable member having a second surface contour shaped to conform to the inside surface, the magnetizable member being sufficiently magnetizable to magnetically couple the removable mask to the outside surface to prevent a coating material from being deposited or plated between the removable mask and the outside surface during a deposition or plating process.

According to another aspect of the invention, a selectively coated substrate made according to a process including the steps of magnetically coupling a removable mask to at least one surface of the substrate; forming a coating of a coating material on the at least one surface of the substrate with the magnetically coupled removable mask using a bath containing the coating material; and selectively decoupling the removable mask from the at least one coated surface to reveal a portion of the coated surface without the coating.

Other aspects, features, and techniques of the invention will become more apparent from the following description taken in conjunction with the drawings.

BRIEF DESCRIPTION OF THE SEVERAL VIEWS OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which like elements are numbered alike in the several FIGURES:

DETAILED DESCRIPTION

Figure 1:
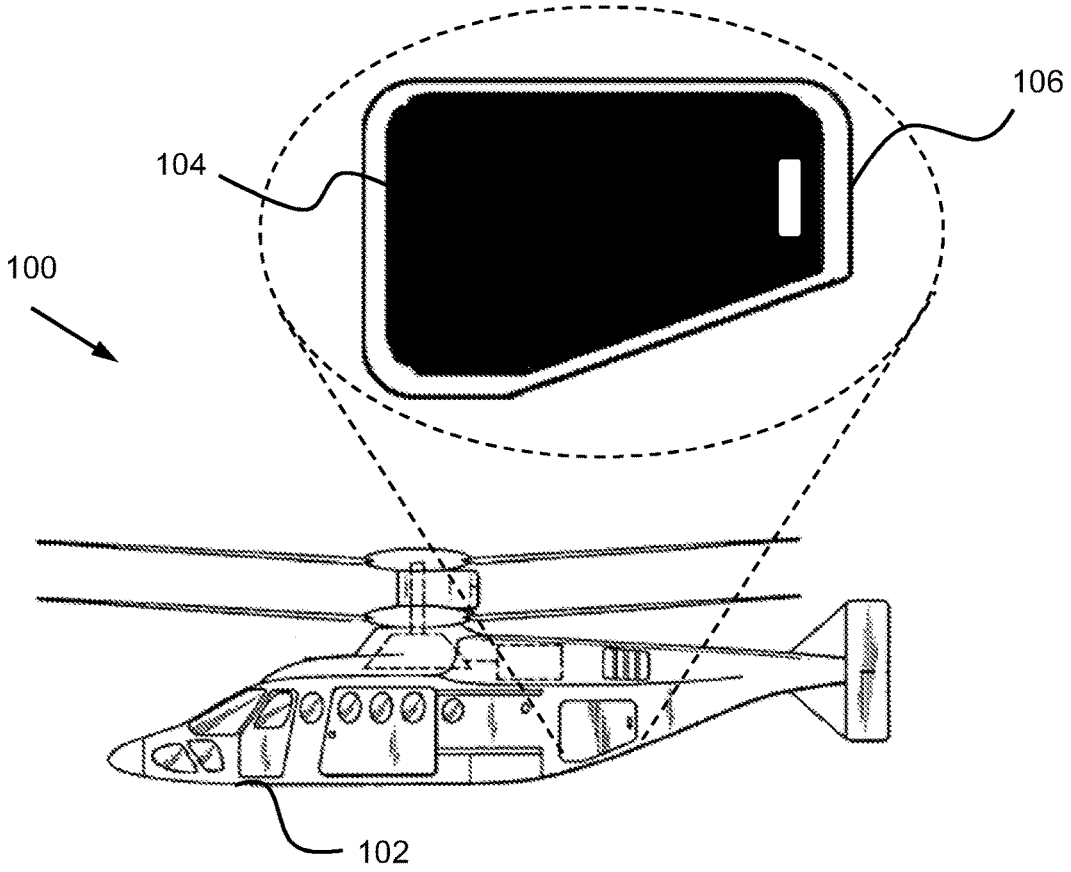
FIG. 1 is a view of an exemplary system according to an embodiment of the invention.

Referring to the drawings, FIG. 1 illustrates an exemplary system 100 with a rotary wing aircraft 102 having a removable mask 104 according to an embodiment of the invention. As illustrated, an aircraft skin such as on, for example, an aircraft door 106 on the rotary wing aircraft 102 may be selectively coupled to a removable mask 104. The aircraft door 106 may be selectively coupled to mask 104 during certain aspects of fabrication of aircraft door 106, for example acid etching, in order to prevent coatings or compositions from infiltrating to its surface. The removable mask 104 may be a two dimensional (2D) or three-dimensional (3D) structure formed into a particular shape in order to follow a contour of a surface of the structure being processed such as, for example, the aircraft door 106. In an embodiment, the removable mask 104 may be formed from a flexible sheet or foil and be stamped out to take various shapes and sizes. In the example illustrated, the removable mask 104 is formed to match a 3D shape of the aircraft door 106 having contours and curvatures. In embodiments, the removable mask 104 may be an electromagnet that is magnetizable by flowing electric current through the removable mask 104, or may be a permanent magnet made from a magnetic rare earth element or other magnetic material therein to adhere to the aircraft door 106 with a magnetic field.

Figure 2:
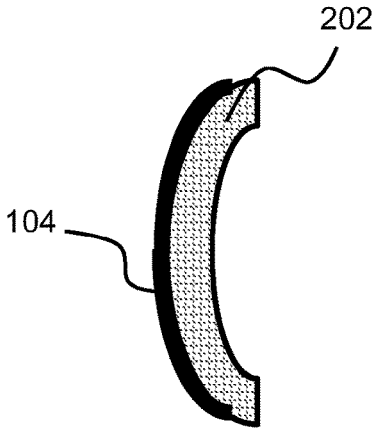
FIG. 2 illustrates a cross-sectional view of a removable mask used for a ferrous substrate during a coating process according to an embodiment of the invention.

FIG. 2 depicts an embodiment of removable mask 104 of FIG. 1 as used on a rigid structure 202 which is formed from a low-alloy ferrous substrate such as, for example, stainless steel or iron. As illustrated, removable mask 104 has a generally arcuate shape and having a thickness as selected or predefined by a user. In another embodiment, the removable mask 104 may be a 2D or 3D shape and may be formed to have an internal surface that follows a contour of an external or internal surface to which it is adhered. In the illustrated figure, the removable mask 104 has a generally arcuate shape and has an internal surface that follows a generally arcuate shape of external surface of rigid structure 202. However, in embodiments, the removable mask 104 may have other 3D geometries without departing from the scope of the invention. As illustrated, removable mask 104 may be used during processing of the rigid structure 202 such as, for example, a section of a tail cone on rotary wing aircraft 102 (FIG. 1). The removable mask 104 being formed from, in one example, a rare earth material may adhere to the ferrous material (i.e., magnetizable material) of rigid structure 202 during aspects of processing of the rigid structure 202 as is described in the embodiment of FIG. 4.

Figure 3:
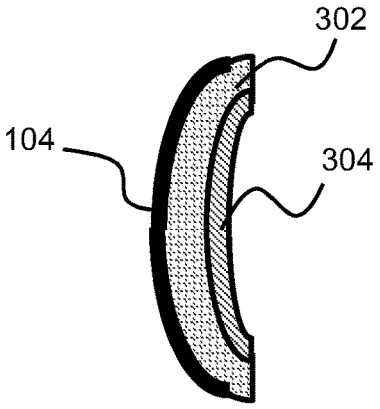
FIG. 3 illustrates a cross-sectional view of a removable mask used for a non-ferrous substrate during a coating process according to an embodiment of the invention.

FIG. 3 depicts an embodiment of removable mask 104 as used on a rigid structure 302 which is formed from a non-ferrous material such as, for example, an aluminum or magnesium alloy. As illustrated, removable mask 104 may be a permanent magnet which is formed from a rare earth material and is provided to magnetically couple to a magnetizable material 304 on an opposite surface of rigid structure 302. The removable mask 104 being formed, in an example, from a rare earth magnet, magnetically holds the magnetizable material 304 against the inside surface of the rigid structure during processing of the rigid structure 302. In embodiments, the removable mask 104 may be a 2D or 3D shape and may be formed to have an internal surface that follows a contour of an external or internal surface to which it is adhered. In the illustrated figure, the removable mask 104 has a generally arcuate shape and has an internal surface that follows a generally arcuate shape of external surface of rigid structure 302.

Figure 4:
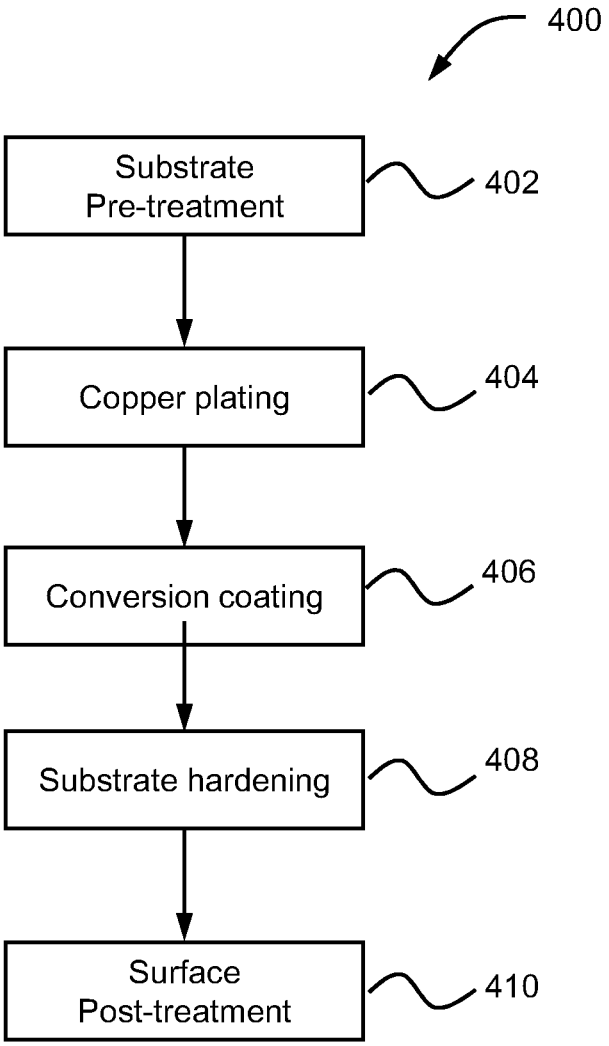
FIG. 4 illustrates a flow chart for an exemplary process for coating a substrate using a removable mask according to an embodiment of the invention.

FIG. 4 illustrates an exemplary process 400 of processing a substrate such as, for example, a substrate made from an aluminum alloy according to an embodiment of the invention. As shown, the exemplary process is initiated by surface pre-treatment process 402 of the substrate during which the substrate undergoes various treatments to yield a surface character suitable for a subsequent electroplating and hardening process. The surface pre-treatment is not only used to remove dirt and organic contaminants from the surface of the aluminum alloy substrate, but also to remove an oxide or a hydroxide formed on the aluminum alloy substrate thereby permitting the surface of the substrate to be exposed for the copper plating process.

According to one exemplary process, the surface pre-treatment process 402 includes removing surface contaminants using a suitable technique such as, in some non-limiting examples, solvent rinsing, vapor degreasing using trichloroethylene or other suitable solvents, solvent emulsion cleaning or the like in order to remove any grease or organic compounds. In an exemplary embodiment, a degreasing bath having an aqueous, non-silicate alkaline solution containing a surfactant may be utilized to clean the substrate. Following degreasing, the substrate is subject to a rinse in a water bath to remove solvents from its surface. In an embodiment, the substrate may be immersed in a second rinse in order to ensure that solvents are not present on the surface. Following water rinse, the substrate may be subjected to a solvent emulsion cleaning or the like in order to remove any grease or organic compounds. Following, solvent emulsion cleaning, the substrate is rinsed in a water bath and, in an embodiment, subjected to an acid etching. In acid etching, the substrate is immersed in an acid bath containing 30% by mass hydrochloric acid (HCL) for a predetermined time in order to remove an oxide layer from its surface. Following the acid bath, the substrate is rinsed in a water bath and dried in preparation for a copper plating process 404. As will be appreciated by those of skill in the art, these surface pre-treatment procedures are susceptible to a wide array of alternatives. Thus, it is contemplated that any number of other procedures and practices may likewise be utilized such as, for example, by mechanical methods or by immersion or spray cleaner systems in order to perform the pre-treatment process of the substrate. Such pre-treatment may not be needed in all aspects of the invention, and different chemicals and processes may be utilized in other aspects.

Figure 5A:
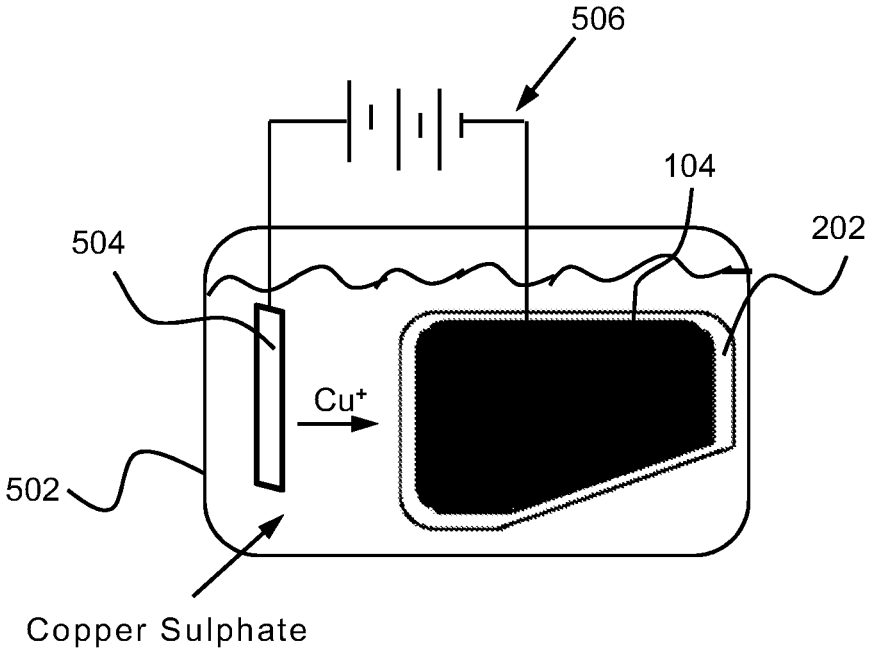
FIG. 5A is a view of a copper plating bath for coating the substrate according to the process of FIG. 4.

Following the surface pre-treatment process 402, the pre-treated substrate is subjected to a copper plating process 404. With further reference to FIG. 5A, the removable mask 104 and/or 304 is attached to the substrate 202 or 302 at this point to protect one or both surfaces during the process 404. In an embodiment, copper electroplating process 404 is a cathodic plating process performed in a bath of copper sulphate. The substrate is used as a cathode, copper as an anode 504, while the copper sulphate is suspended in the bath. Copper plating 404 may be performed by applying a negative DC charge to the substrate through a battery 506. The oppositely charged copper molecules in the bath are drawn to the cathodic substrate and deposit on the surface of the substrate that is not concealed by the removable mask 104 and/or 304. The copper coated substrate is rinsed in water and dried. In an alternative embodiment, an anodic copper plating may also be used in lieu of cathodic copper plating. In this way, in the shown embodiment, portions of the surfaces are made conductive, and portions covered by the mask 104 and/or 304 are made non-conductive. While described in terms of copper plating, it is understood that other types of metal plating or deposition can be used. Further, the bath 502 can occur in a dedicated vat or tank 502, or can be in the same bath or tank used in the pre-treatment process 402.

Figure 5B:
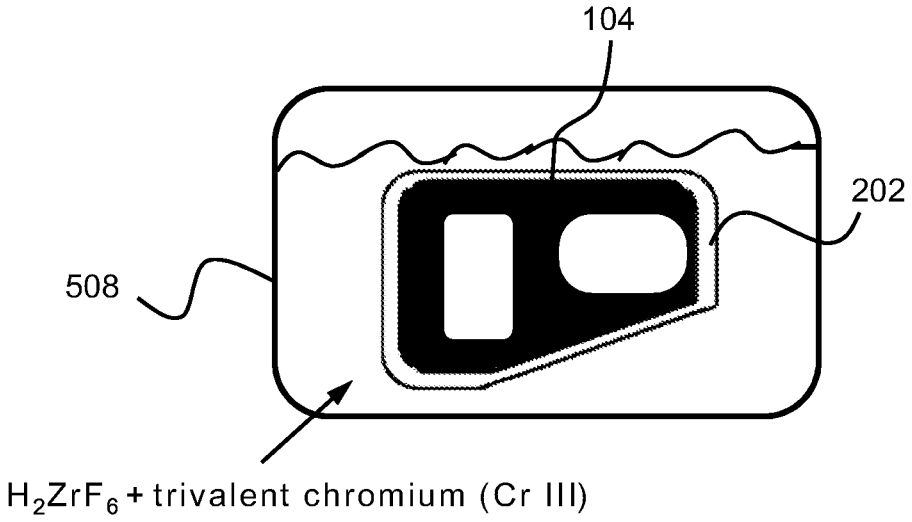
FIG. 5B illustrates an exemplary view of a bath having chemicals to coat the substrate according to the process of FIG. 4

Next, in an embodiment, the copper plated substrate includes a corrosion inhibitive conversion coating process 406 with a trivalent chromium-containing layer in order to protect the surface from corrosion. As the conversion coating is conductive, areas of the substrate that are to be made non-conductive are covered with the removable mask 104 and/or 304. As such, the mask 104 and/or 304 need not be applied in the coating process 404 where the plating is desired, and can be applied afterwards to block the application of subsequent layers in a subsequent process such as process 406. The removable mask 104 and/or 304 prevents the conversion coating from infiltrating through it and coating the covered surface. With reference to FIG. 5B, in an embodiment, removable mask 104 is attached to a first surface and a magnetizable material 304 is coupled at an opposite surface of the substrate at a location adjacent to an inside surface of the removable mask in order to selectively and frictionally hold the removable mask 104 to the aluminum alloy substrate. The substrate including the removable mask 104 and magnetizable material 304 is immersed in the treatment bath inside vat or tank 508. The treatment bath includes an aqueous solution having a salt of hexafluorozirconic acid and a water soluble trivalent chromate compound, which is free of hexavalent chromium. In one exemplary embodiment, the trivalent chromate compound is trivalent chromium sulfate. The water soluble trivalent chromate compound is present in the aqueous solution in sufficient concentrations to coat the surfaces of the pre-treated heat exchanger with a uniform layer of trivalent chromium. In one exemplary embodiment, the aqueous solution can include Surtec 650, which is a commercially available liquid trivalent chromium based chemical available from CST-SurTec, Inc. In a non-limiting embodiment, the substrate is immersed for about 10 minutes at ambient temperature of about 30 degree Celsius (about 303 Kelvin) to about 40 degree Celsius (about 313 Kelvin) in order to induce the conversion coating on the surface. In other non-limiting embodiments, the aqueous solution may contain fluoride and fluoborate. It is to be appreciated that the acidic fluoride character of the conversion coating solution removes the native oxide films and replaces it with hydrated Al—Zr—O—F layer, which increases the hydrophilicity of the surface of the substrate and activates the surface for organic coating. In an embodiment, the conversion coated substrate is evaluated by visual inspection. While a specific process 406 is described above, it is understood that other chemicals, temperatures and timings can be used according to the specific application, and that process 406 need not be used in all aspects of the invention such as where a conversion coating is not needed.

In an exemplary embodiment, following conversion coating process 406, the substrate is subjected to substrate hardening process 408. In an embodiment, the removable mask 104 is removed from the copper plated substrate prior to the copper plated substrate being inserted into a carburization chamber, although it is understood that the mask 104 and/or 304 could be left on in other aspects. In embodiments, the copper plated substrate may be carburized in a carburization chamber using a source of carbon and at an elevated temperature. In an embodiment, gas carburizing may be utilized at a temperature within the range of 900 degree Celsius (1173 Kelvin) to 950 degree Celsius (1253 Kelvin) using carbon monoxide gas as the carbon source. In another embodiment, liquid source may be used such as, for example, a molten salt of sodium cyanide and barium chloride is used. It is understood that the hardening process 406 is not required in all aspects, and that other temperatures and materials can be used according the specific application in other aspects.

Lastly, the substrate surface is subjected to a surface post-treatment process 410 which may include removing chemical contaminants using a suitable technique such as, in some non-limiting examples, immersion in a water bath, solvent rinsing, vapor degreasing or other suitable solvents, solvent emulsion cleaning or the like in order to remove any compounds. It is understood that the post-treatment process 410 is not required in all aspects or can be provided at a separate facility.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Further, while described in the context of the manufacture of parts for a helicopter, it is understood that aspects can be used in other contexts in which a coating is to be selectively disposed on a surface, such as in semiconductor manufacturing. Many modifications, variations, alterations, substitutions, or equivalent arrangement not hereto described will be apparent to those of ordinary skill in the art without departing from the scope and spirit of the invention. Additionally, while the various embodiment of the invention have been described, it is to be understood that aspects of the invention may include only some of the described embodiments. Accordingly, the invention is not to be seen as limited by the foregoing description, but is only limited by the scope of the appended claims.

What is claimed:

1. A method for selectively coating a substrate, comprising:

magnetically coupling a removable mask to at least one surface of the substrate;

forming a coating of a coating material on the at least one surface of the substrate with the magnetically coupled removable mask using a first bath containing copper plating materials to form a copper plating on the at least one surface of the substrate and a second bath containing conversion treatment coating materials to form a conductive conversion coat on the copper plating; and selectively decoupling the removable mask from the at least one coated surface to reveal a portion of the surface without the coating.

2. The method of claim 1, wherein the removable mask and the substrate are magnetically attracted to each other to provide an adhesion force to magnetically couple the at least one surface to the removable mask.

3. The method of claim 2, wherein the magnetically coupling comprises making the removable mask magnetic by applying an electrical current to the removable mask.

4. The method of claim 1, wherein the magnetically coupling comprises:

attaching a magnetizable mask to an opposite surface such that the substrate is between the removable and magnetizable masks;

wherein the removable mask is magnetic, and the magnetizable mask is attracted to the removable mask so as to provide an adhesion force to magnetically couple the at least one surface to the removable mask.

5. The method of claim 1, further comprising subjecting the at least one surface to a pre-treatment process including at least one of a cleaning, a vapor degreasing using trichloroethylene, solvent emulsion cleaning, or immersion in a surfactant.

6. The method of claim 1, further comprising subjecting the at least one surface to a copper plating to form a copper plated substrate.

7. The method of claim 6, wherein the copper plating further comprises subjecting the substrate to a cathodic copper plating with the substrate being the cathode.

8. The method of claim 6, wherein the copper plating further comprises subjecting the substrate to an anodic copper plating with the substrate being the anode.

9. The method of claim 1, further comprising subjecting the at least one coated surface to a post-treatment process.

10. The method of claim 1, wherein the forming of the coating further comprises conversion coating the at least one surface of the substrate with a trivalent chromium compound.

11. The method of claim 10, wherein the conversion coating further comprises immersing the substrate in a conversion treatment bath having dissolved species of a water soluble trivalent chromium compound and a salt of hexafluorozirconic acid.

12. The method of claim 10, wherein the trivalent chromium compound is trivalent chromium sulfate.

13. The method of claim 10, wherein the conversion coating further comprises immersing the substrate in the second bath for a predetermined contact time in an ambient temperature environment.

14. A method for selectively coating a surface of a substrate, the method comprising:

forming a removable mask to conform to contours and curvatures of the surface;

magnetically coupling the removable mask to the surface to define masked and exposed portions of the surface;

forming a coating of first and second coating materials on the exposed portion of the surface by:

immersive electroplating of at least the substrate in a first bath in which metallic molecules are suspended, and immersive treating of the substrate and the removable mask in a second bath of an aqueous salt solution and a trivalent chromate solution; and with the coating hardened, decoupling the removable mask from the surface.

* * * * *